US012151146B2

(12) United States Patent
Adler

(10) Patent No.: US 12,151,146 B2
(45) Date of Patent: Nov. 26, 2024

(54) MODULAR GOLF CLUB COVER RETAINER

(71) Applicant: Mitch Adler, Rancho Santa Fe, CA (US)

(72) Inventor: Mitch Adler, Rancho Santa Fe, CA (US)

( * ) Notice: Subject to any disclaimer, the term of this patent is extended or adjusted under 35 U.S.C. 154(b) by 0 days.

(21) Appl. No.: 17/798,390

(22) PCT Filed: Feb. 18, 2022

(86) PCT No.: PCT/US2022/017033
§ 371 (c)(1),
(2) Date: Aug. 9, 2022

(87) PCT Pub. No.: WO2022/178284
PCT Pub. Date: Aug. 25, 2022

(65) Prior Publication Data

US 2024/0123300 A1 Apr. 18, 2024

Related U.S. Application Data

(60) Provisional application No. 63/150,952, filed on Feb. 18, 2021.

(51) Int. Cl.
*A63B 55/00* (2015.01)
*A63B 60/62* (2015.01)

(52) U.S. Cl.
CPC ..... *A63B 55/408* (2015.10); *A63B 60/62* (2015.10)

(58) Field of Classification Search
CPC ..... A63B 55/408; A63B 60/62
USPC ..... 206/315.4
See application file for complete search history.

(56) References Cited

U.S. PATENT DOCUMENTS

2004/0031828 A1* 2/2004 Ziegler ..... A63B 71/0672 224/269
2009/0209369 A1* 8/2009 Smith ..... A63B 57/10 224/183
2021/0059298 A1* 3/2021 Holmes ..... A24F 13/08

* cited by examiner

*Primary Examiner* — Don M Anderson
*Assistant Examiner* — Jessica Kavini Tamil
(74) *Attorney, Agent, or Firm* — Donn K. Harms

(57) ABSTRACT

A golf club cover retainment system for holding golf club covers proximate to a golf bag once the covers are removed from clubs in the golf bag. A clip positioned on a flexible member extending from a reel within a housing engages with a club cover. The housing is connected to the golf bag by a bag connector. A plurality of additional housings may be engaged to form a sequential engagement of multiple housings where each has a flexible member which may be connected to a different golf club cover.

4 Claims, 6 Drawing Sheets

MODULAR GOLF CLUB COVER RETAINER

This application claims priority to U.S. Provisional Patent Application Ser. No. 63/150,952, filed on Feb. 18, 2021, which is incorporated herein in its entirety by this reference thereto.

BACKGROUND OF THE INVENTION

1. Field of the Invention

The present invention relates generally to the game of golf. More particularly, it relates to a reeled golf club cover retainment system which is modular and thereby allows for reeled retainment of one or a plurality of golf club covers on retractable flexible members or lanyards.

2. Prior Art

The game of golf has been played worldwide for hundreds of years. While equipment has evolved over time, the basic game still employs a set of golf clubs which are specialized to yield a particular flight of a golf ball when struck correctly.

Many of the golf clubs carried in a golf bag by golfers are protected by golf club covers. Such may be made of woven or unwoven fabrics and are conventionally engaged upon the head portions of the clubs chosen for such covers.

When so engaged, conventional golf club covers are configured to protect the golf club heads and shafts from dirt and damage which can occur when the clubs are jostled during movement of the golf bag. Additionally, some golf club covers can have value as souvenirs and bear indicia about a golf course the golfer has played in the past.

Whether used just for club protection or held and employed for souvenir value, such golf club covers can easily be lost when dismounted from a club being used. This occurs when they are left at a position where the golfer may have removed them and dropped them or forgotten them. Such is a significant problem where the covers cannot be replaced or are costly to replace.

With respect to the above, before explaining at least one preferred embodiment of the golf club cover retainment system herein, it is to be understood that the disclosed retainment device and system are not limited in application to the details of employment and to the arrangement of the components or the steps set forth in the following description or illustrated in the drawings. The various apparatus and operations of the herein disclosed golf club cover retainment system herein are capable of other embodiments, and of being practiced and carried out in various ways, all of which will be obvious to those skilled in the art once the information herein is reviewed.

Also, it is to be understood that the phraseology and terminology employed herein are for the purpose of description, and should not be regarded as limiting. As such, those skilled in the art will appreciate that the conception upon which this disclosure is based, may readily be utilized reeled golf club cover retainment systems. It is important, therefore, that the embodiments, objects and claims herein, be regarded as including such equivalent construction and methodology insofar as they do not depart from the spirit and scope of the present invention.

SUMMARY OF THE INVENTION

The golf club cover retention system herein disclosed and described provides for the reeled retainment of individual golf club covers to the golf bag in which the golf clubs on which the club covers are situated. In a simplest mode of the device, a primary reeled retainer can be employed which has a flexible member or lanyard which is engaged to an internal reel.

The flexible member may be metal or polymeric, natural fiber, or metal formed to a flexible member, or other flexible material which will wind on an internal reel and thereby connect the reel and the surrounding housing to the chosen golf club cover. A fastener located at the distal end of the flexible member is configured for a secure engagement with the golf club cover of choice. Such may be a spring loaded clip, mating fasteners on the cover and the flexible member, magnets, or other connectors configured for a connection to a golf club cover. Currently preferred is a clip which engages a portion of the cover between two coaxial round connector portions which has been found in experimentation, to form a non-slip and especially secure connection of the clip to the cover. Additionally, a rotating barrel connector positioned between the clip and the flexible member has been found to reduce twisting of the flexible member when in use. While the device works well with a clip having the coaxially positionable connector portions, and without such a rotating barrel connector, the addition of the rotational barrel in combination with the clip, was found in experimentation to enhance the prevention of snags and other problems with the flexible member when retracted upon the reel which occurred without the rotating barrel.

The retainment system herein can be used in singular reels and can also be employed in a modular configuration to allow for a plurality of first and secondary housings to be engaged together. Each of the housings has a flexible member operatively engaged with an interior-positioned reel.

Each of the secondary housings are configured with connectors on one side of their housing which will allow for a removable engagement with receptors on the opposite side of the housing of an adjacent reel housing. Thus, a first secondary housing may be removably engaged with the primary housing and thereby form a modular retainment system with two reels and two flexible members which will connect to two golf club covers.

Because the secondary housing has housing connectors on an opposite side from its connection to the first or primary housing, a third housing with a third reel and flexible member can be engaged therewith, as well as subsequent connected housings to form a plurality of housings connected in a sequential engagement to each other. By sequential engagement is meant herein that a first or primary housing is connectable to a golf bag and any number of secondary housings are engaged to the first housing and each other in a row, wherein only the first housing need be connected to the bag. The modular system thus allows the user to engage any number of secondary housings with reeled flexible members to a primary housing in a modular retainment system.

The reels of each of the primary housing and the secondary housings are configured to unwind and allow a flexible member, wound thereon, to connect to an individual chosen golf club head cover. As noted, at the distal end of each flexible member, opposite the first end which is engaged to a reel, is positioned a clip to removably connect the flexible member to a chosen golf club cover. Such, for example, may be a spring loaded alligator type clips (well known), magnets, snaps, buttons, or other grasping fasteners adapted to engage the distal end of a flexible member, to a chosen club cover.

Currently, a spring loaded clip having coaxially positionable connectors on opposing clip members, which hold a cover therebetween around a circumference of each, is preferred due to the especially secure connection which resists sliding and slipping of the cover from the clip. Additionally preferred are a rotating barrel positioned in between the distal end of the flexible member and the clip.

Currently, in one preferred mode of the system herein, the connectors positioned on a first sidewall of the first or primary housing are configured for engagement to a mating connector located on a sidewall of adjacently positioned housings. One such connector is a twist lock engagement of receptors on the first or primary housing and an adjacent secondary housing. Such a twist lock is accomplished by projections forming the connectors and by recesses on the adjacent housing forming the receptors. Thus, a user need only line up and insert the mating connectors on one housing into the recesses of an adjacent housing, and then rotate them in opposite directions to thereby lock the projections into the recesses.

Alternatively, magnets on the first or primary and the secondary housings can magnetically connect to magnetically attractive locations on adjacent housings. In another mode, first connectors, on one side of each housing, are configured to engage with secondary connectors on a side of secondary housings to provide for this sequential engagement of additional housings to the primary housing and secondary housings as needed. This ability to connect additional housings in sequence is especially preferred, in all modes of the device, to allow the user to add as many housings with reels and flexible members connected to more club covers as needed.

With respect to the above description, before explaining at least one preferred embodiment of the herein disclosed modular golf club cover retainment system herein, it is to be understood that the invention is not limited in its application to the details of construction and to the arrangement of the components in the following description or illustrated in the drawings. The invention herein described, is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based, may readily be utilized as a basis for designing of other reeled modular golf club cover retainment systems and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, the term "substantially" if not otherwise defined for size or dimension or positioning of a specific part or configuration, means plus or minus ten percent.

It is an object of this invention to provide a modular system for attaching flexible members to golf club covers where a primary housing of the system engages with a golf bag and secondary housings will engage with the primary housing and/or secondary housings and provide a flexible member to engage with a chosen golf club cover.

Other objects, features, and advantages of the present golf club cover retainment system, as well as the advantages thereof over existing prior art, will become apparent from the description to follow, and are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the various modes of the modular golf club cover retainment invention herein which as noted may be employed singularly or in combination. It is intended that the embodiments and figures disclosed herein are to be considered illustrative rather than limiting.

Figure 1:
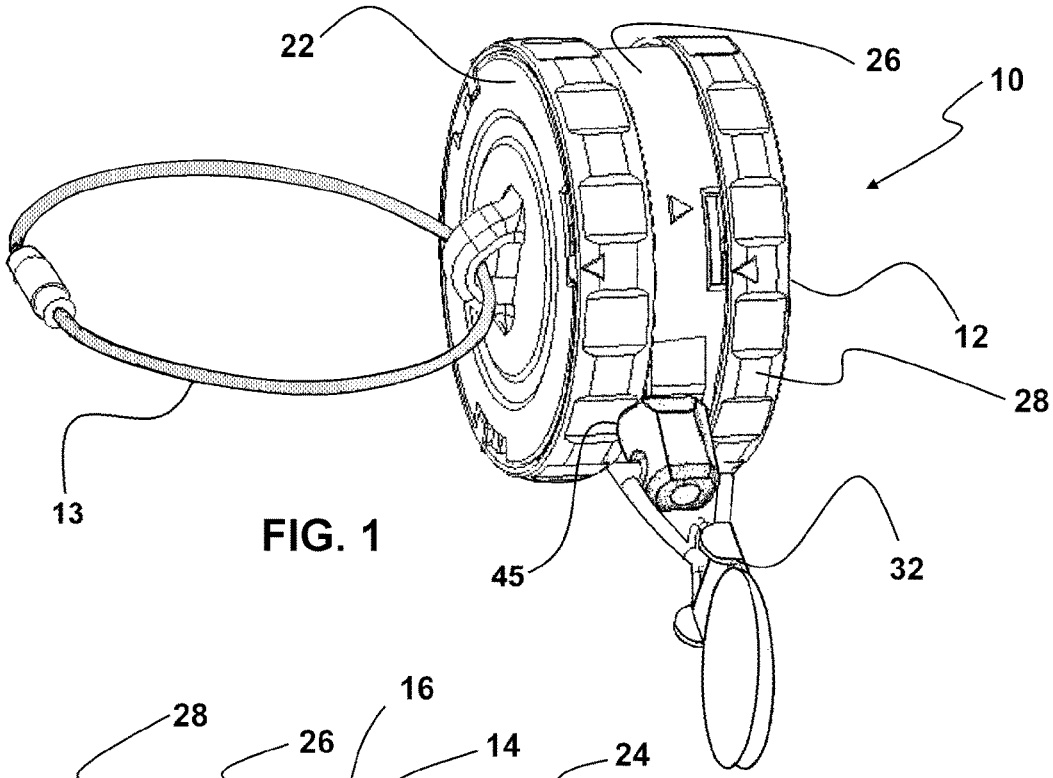
FIG. 1 shows a perspective view of a housing, such as the primary housing of the modular system herein, showing a bag fastener connected to the housing for engaging it to a golf bag, and showing a cover fastener positioned on a distal end of reel-engaged flexible member, which is engageable with a golf club cover.

Other aspects of the present golf club cover retainment system herein shall be more readily understood when considered in conjunction with the accompanying drawings, and the following detailed description, neither of which should be considered limiting.

DETAILED DESCRIPTION OF THE PREFERRED

Embodiments of the Invention

In this description, the directional prepositions of up, upwardly, down, downwardly, front, back, top, upper, bottom, lower, left, right, first, second, and other such terms refer to the device as it is oriented and appears in the drawings and are used for convenience only, and they are not intended to be limiting or to imply that the modular golf club cover retainment device has to be used or positioned in any particular orientation.

Figure 2:
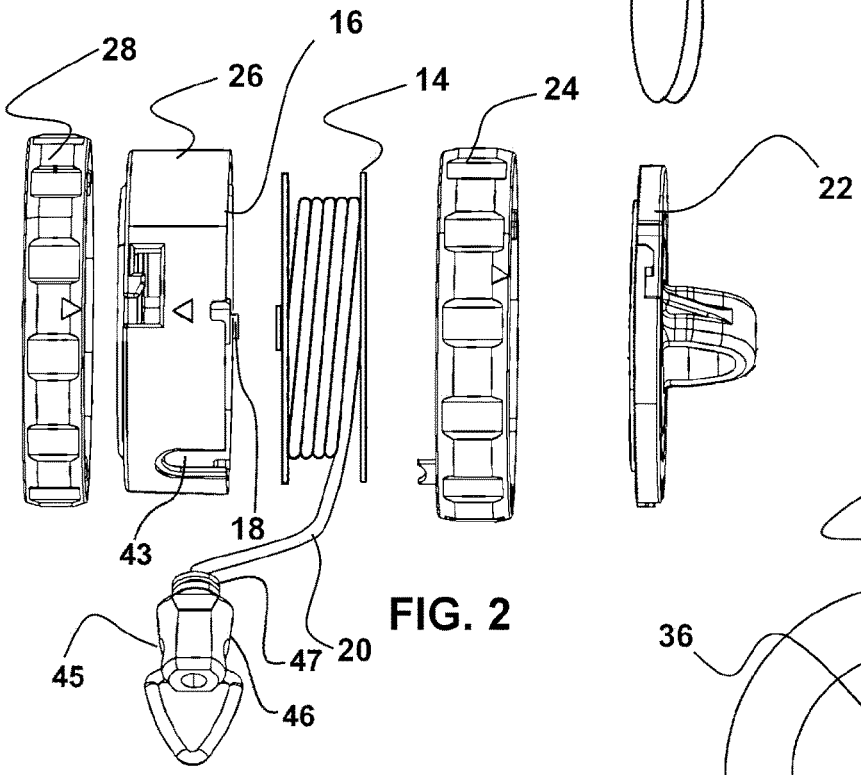
FIG. 2 depicts an exploded view of the device of FIG. 1 showing the first sidewall and second sidewall and the reel for positioning within the surrounding sidewall.

Now referring to drawings in FIGS. 1-12, wherein similar components are identified by like reference numerals, there is seen in FIGS. 1-2 the perspective and exploded views of a simplest mode of the cover retainment system 10 herein. Such includes a first housing or primary housing 12 having a reel 14 rotationally engaged within an interior cavity 16 of the primary housing 12. The reel 14 is engaged upon an axle 18 or other means for rotational engagement which allows the reel 14 to operatively rotate and wind and unwind the flexible member 20 wound thereon. The operation of the reel 14 within the interior cavity 16 of secondary housings 17 as in FIGS. 6-7 and 9-10, for example, is the same as that described herein as the reel 14 within the primary housing 12.

As shown in FIG. 2, the primary housing 12 includes a first sidewall 22 which is engaged to or otherwise forms a sidewall for the internal cavity 16, in the form of a cavity sidewall 24. Such engagement may be permanent or the first sidewall 22 may include the cavity sidewall 24 as part thereof, and it may be removable for servicing the interior components.

The reel 14, as noted, is rotationally engaged within the interior cavity 16 upon an axle 18. A surrounding sidewall 26 is engaged between the first sidewall 22 or the first cavity sidewall 24 and a second sidewall 28.

While not required, the engagement of the first cavity sidewall 24 and second sidewall 28 to opposing sides of the surrounding sidewall 26 is preferably removable to allow access to the interior cavity 16 for insertion and removal of the reel 14. Such may be by snaps, clips, mating fasteners, or by using projections on one component operatively engageable with receptors on the other.

Figure 8:
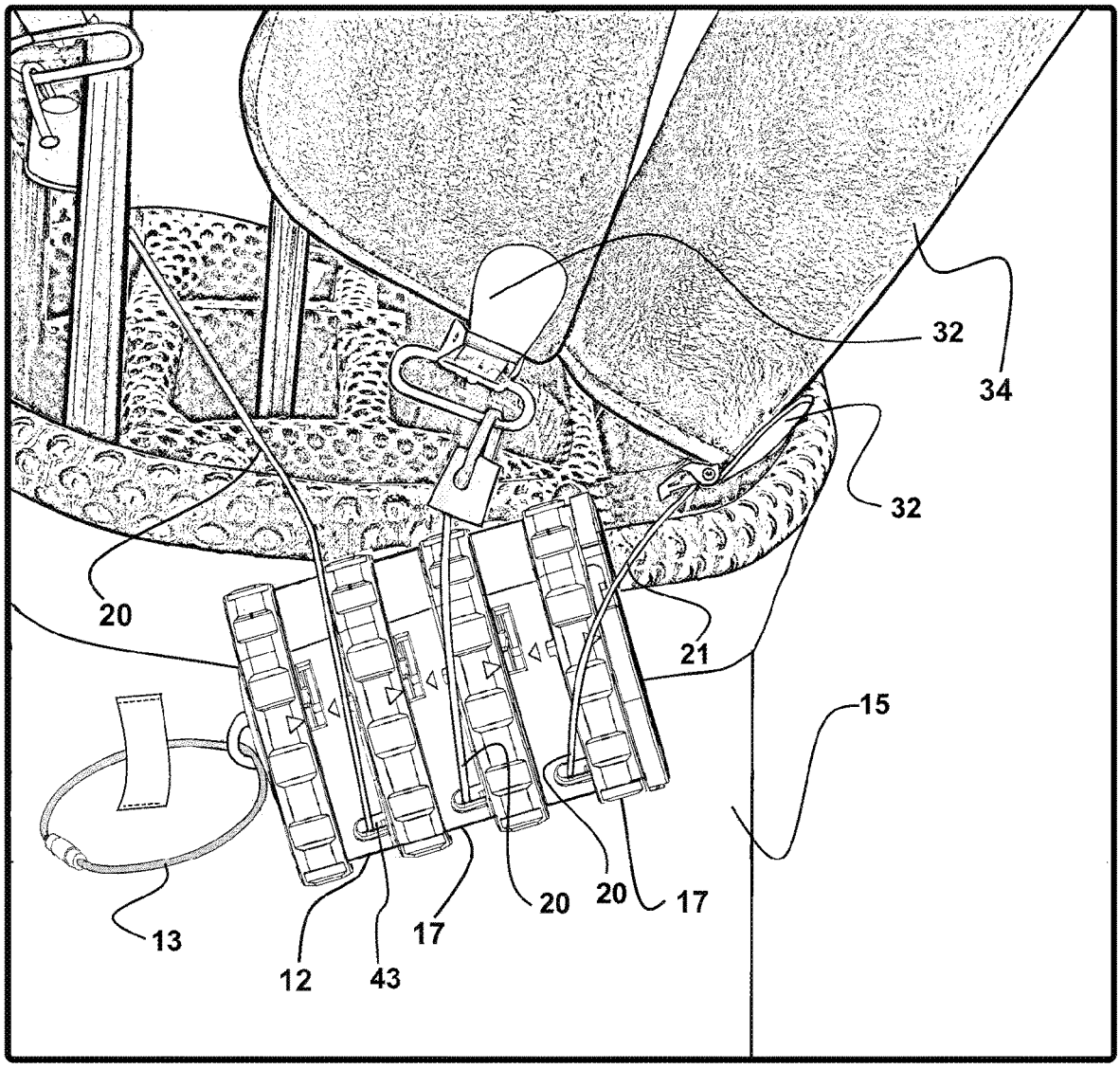
FIG. 8 depicts the system herein wherein a first or primary housing is operatively engaged with a golf bag having flexible members from the primary housing and from secondary housings engaged with a plurality of golf club head covers.
Figure 9:
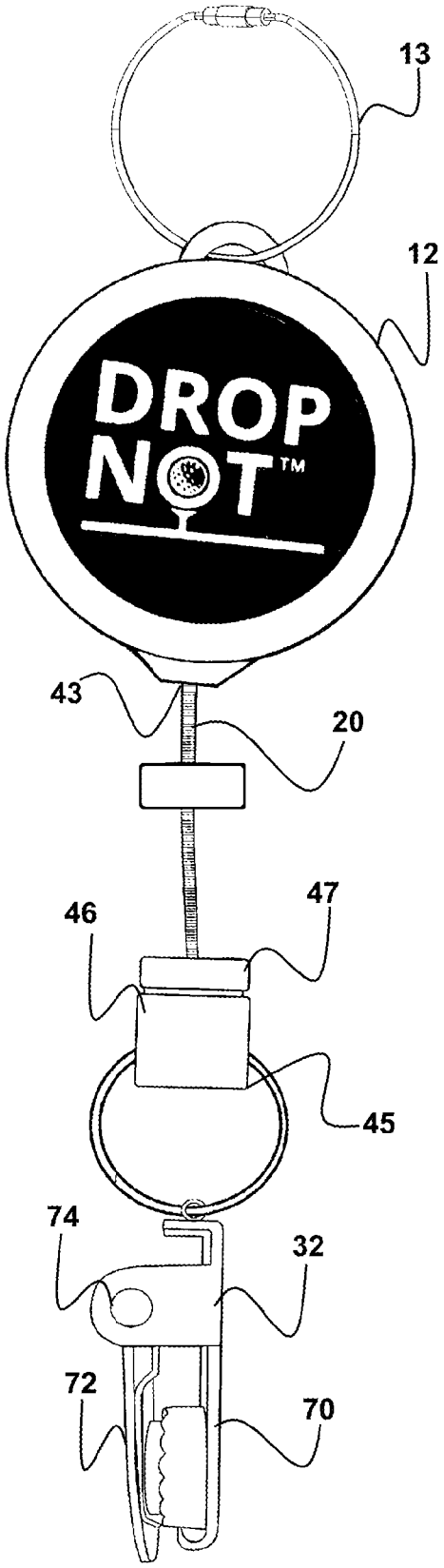
FIG. 9 depicts a mode of the device herein showing a mode of the housing having a connector to engage a golf bag and showing the flexible member having a rotating barrel connected between the flexible member and the clip.

In both of the primary housing 12 and secondary housings 17, the reel 14 is wound with a flexible member 20 formed of wire, polymeric, or plastic material which will wind and unwind from the reel 14, as needed. In all modes of the system 10, a clip 32 is engaged with the distal end of the flexible member 20 which extends from a first end connection to a reel 14 of an assembled device 10. Each clip 32 is configured for a biased removable engagement to a golf club cover 34 such as is shown in FIG. 8. Such clips 32 may be, for example, spring loaded alligator type clips, magnetic clips, or other fasteners adapted to removably engage to the golf club cover 34. The clip 32 of FIGS. 9-12 is especially preferred as during experimentation it was found that a more secure engagement to the club cover 34 was achieved by the coaxial positioned first contact and second contact thereof when biased to the closed position by an onboard spring.

Figure 3:
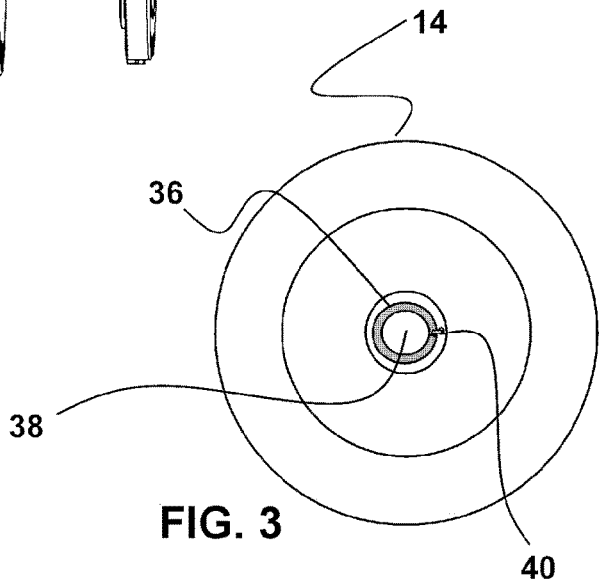
FIG. 3 shows a side view of a reel which is rotationally engaged within the primary and secondary housings and shows a spring loaded center bearing which imparts a bias to an engaged flexible member in a direction to wind upon the reel.

In FIG. 3 is shown a side view of a reel 14 which is rotationally engaged upon a bearing 36, having a bearing opening 38 therein adapted to engage upon an axle 18 or other mount for the reel 14, positioned in an interior cavity 16 of each primary housing 12 or secondary housing 17. The reel 14 is biased in a direction to wind the flexible member 20 upon the reel 14, such as by a conventional circular spring 40 operatively connected between the reel 14 and the axle 18. This spring loading causes the reel 14 to continuously exert biasing force to rotate and retract the flexible member 20. This biasing and winding force helps keep the flexible member 20 taught when it is engaged to a cover 34 and to wind it up when not, and to keep the taught flexible member 20 from catching on clubs and the like.

Figure 4:
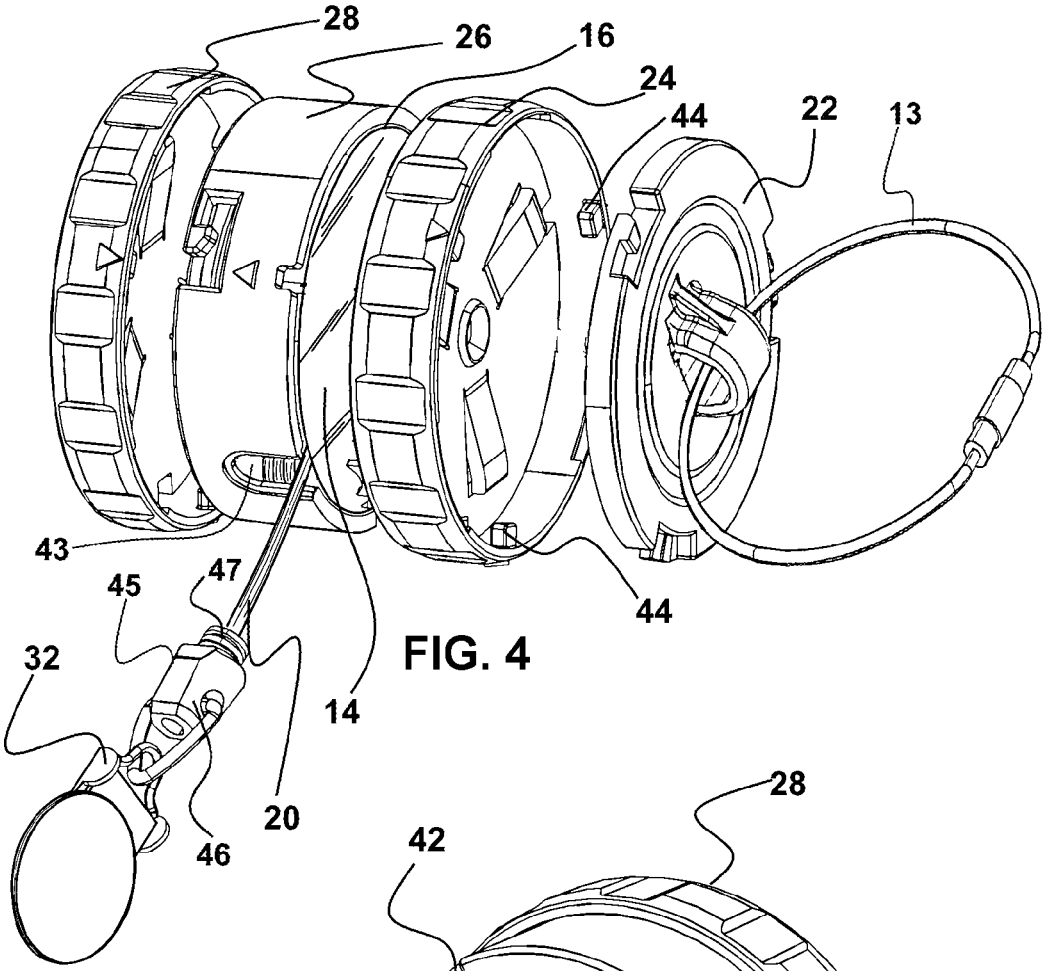
FIG. 4 depicts an exploded perspective view of a first or primary housing showing an axle-mounted reel, operatively engaged in the same fashion as a reel is engaged with secondary housings.

Shown in FIG. 4 is a perspective exploded view of a mode of the primary housing 12. The secondary housings 17 are configured to operate in the same fashion. As shown, the reel 14 is positioned within the interior cavity 16 which is defined by the surrounding sidewall 26 in a sandwiched positioning in between the first sidewall 22 and first cavity sidewall 24 and the second sidewall 28. As noted, the first sidewall 22 can be part of the first cavity sidewall 24. The biased flexible member 20 extends from an opening 43 communicating with the interior cavity 16.

A clip 32 is engaged at the distal end of the flexible member 20, either directly, or more preferably, in a rotating connection. By rotating connection is meant herein that the clip 32 will rotate in a connection at the second end of the flexible member 20 without twisting the flexible member 20.

Currently, such a rotating connection is achieved using a barrel connector 45 in-between the clip 32 and flexible member 20. The barrel connector 45 has a barrel 46 which rotates around a shaft 47 extending to the connection to the flexible member 20 and engages to the clip 32 to allow the clip 32 to rotate with the barrel 46 around the shaft 47. This is preferred as it allows the clip 32, and any club cover 34 engaged thereto, to rotate without twisting the flexible member 20. This prevents kinks and other issues which would develop from twisting of the flexible member 20 which might jamb the reel 14. Other rotating connections as would occur to those skilled in the art may be employed and are considered within the scope of this patent.

Figure 5:
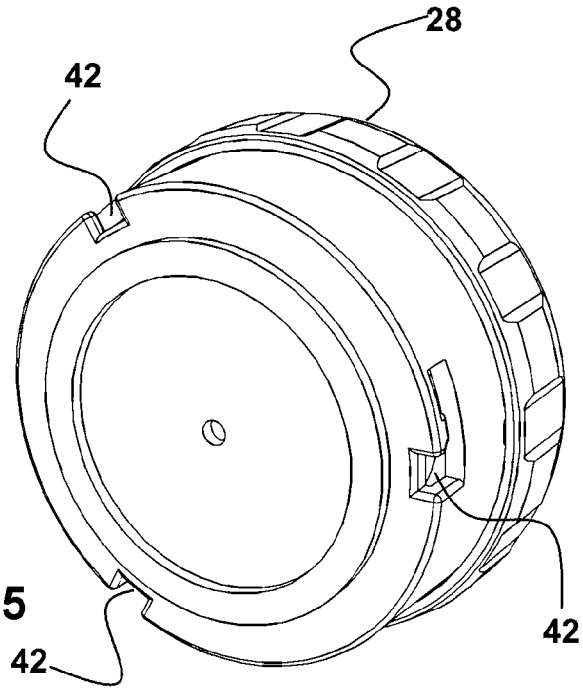
FIG. 5 shows one mode of housing connector for engaging adjacent housings in the form of recesses which form receptors for the plurality of projections positioned on an adjacent housing, whereby the projections will twist lock into the recesses.

In FIG. 5 is shown a typical second sidewall or second sidewall 28 which is positioned on the second side of the surrounding sidewall 26 of the primary housing 12 and secondary housings 17. A first half of a housing connector is shown located on this second sidewall 28 which is configured to engage a second half of a housing connector located on an adjacent primary or secondary housing. This allows for the engagement of a plurality of housings together, such as in FIGS. 7-8, wherein a primary housing 12 is engaged to the golf bag and the secondary housings 17 are engaged to the primary housing 12 and each other in a row.

Figure 7:
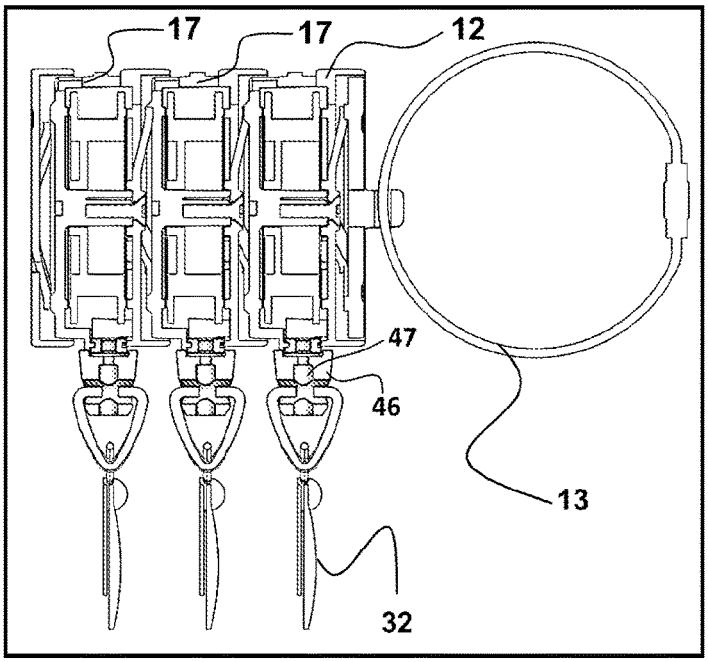
FIG. 7 shows a mode of the modular reeled golf club retainer system herein, showing a primary housing configured for engagement to a golf bag and two secondary housings engaged with housing connectors such as in twist locked connections to each other using the projections and recesses operatively positioned in adjacent housings.

In the mode of the housing connectors shown in FIG. 5, at least one and preferably a plurality of receptors 42 are positioned to engage with projections 44 (FIG. 4) to thereby engage a secondary housing 17 to an adjacent primary housing 12 or to a secondary housing 17 which is already connected to the primary housing 12. Other housing connectors may be employed, such as adhesive pads or connectors, where a first half on one housing engages a second half thereof on an adjacent housing, so long as a plurality of housings 12 and 17 can be engaged sequentially in a sequential engagement forming a row of housings such as depicted in FIGS. 7-8.

Figure 6:
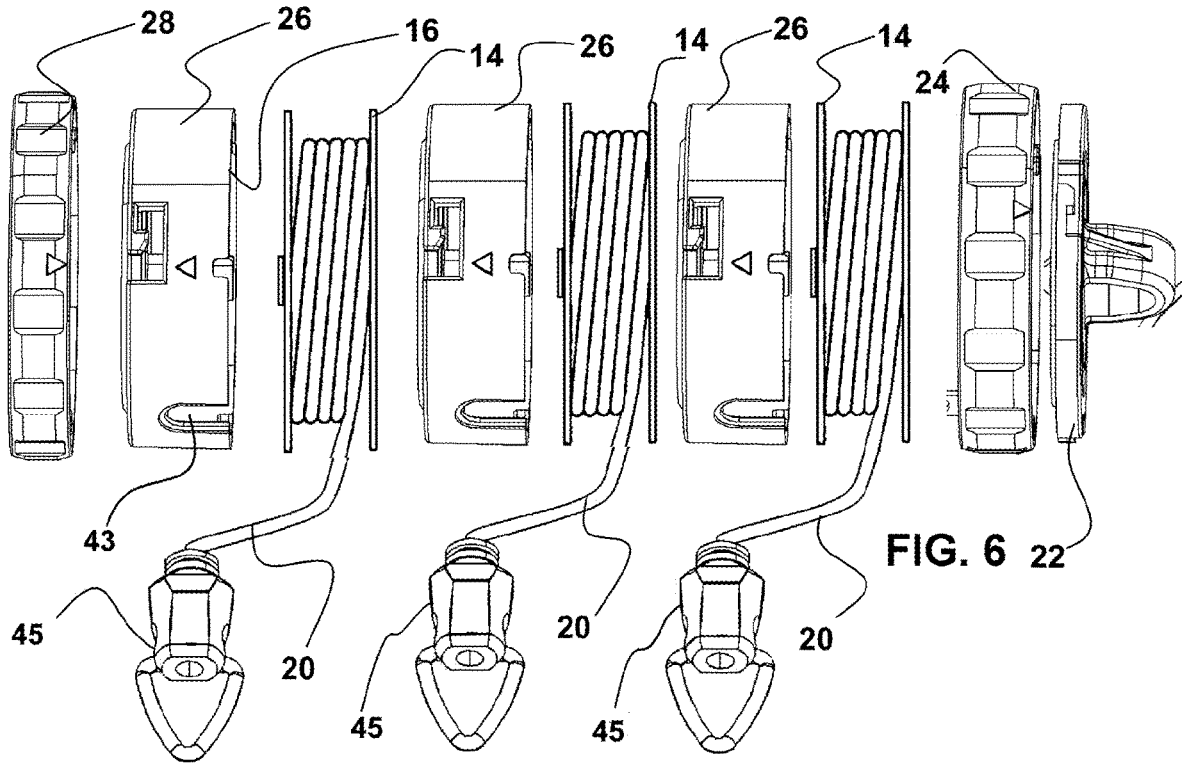
FIG. 6 depicts an exploded view of an example of a first or primary housing and reel and two secondary housings and reels which may be engaged in a manner shown in FIG. 7.

Depicted in FIG. 6 is one example of a plurality of secondary housings 17 which engage to each other, by housing connectors, and to a primary housing 12 of the system 10 herein. As shown, each has a spring-loaded or biased reel 14 which is operatively positioned in a respective interior cavity 16. Each reel 14 has a flexible member 20 thereon which has a clip 32 at a distal end which is configured to removably engage with a golf club head cover 34 (FIG. 8). As can be surmised, any number of secondary housings 17 can be engaged with a primary housing 12 and each other to form the system 10 herein with any number of flexible members 20 to connect with an equal number of covers 34. The mode of the device in FIG. 6 is shown assembled and operatively interconnected in FIGS. 7-8.

In FIG. 8, the system 10 is shown in a deployed mode where a primary housing 12 which has a bag connector 13 for engaging it to the golf bag 15 is connected to a plurality of secondary housings 17 connected to each other. Each has a flexible member 20 which is connected by a clip 32 which connects to a respective club cover 34. This connection of the clips 32 holds the covers 34 proximate to the golf bag 15 once they are removed from a club which they cover.

Also shown in FIG. 8 is the taught length of the flexible member 20 extending between each opening 43 and each clip 32 operatively engaged with each cover 34. The reel 14 being continuously biased to wind the flexible member 20 thereon, by a spring 40 or similar biasing component, acts to continuously form this taught length therebetween. This is preferred, as in experimentation holding the flexible member 20 taught between each club cover 34 prevented snags and tangling with the other flexible members 20 and the bag 15 and clubs and components therein.

Figure 10:
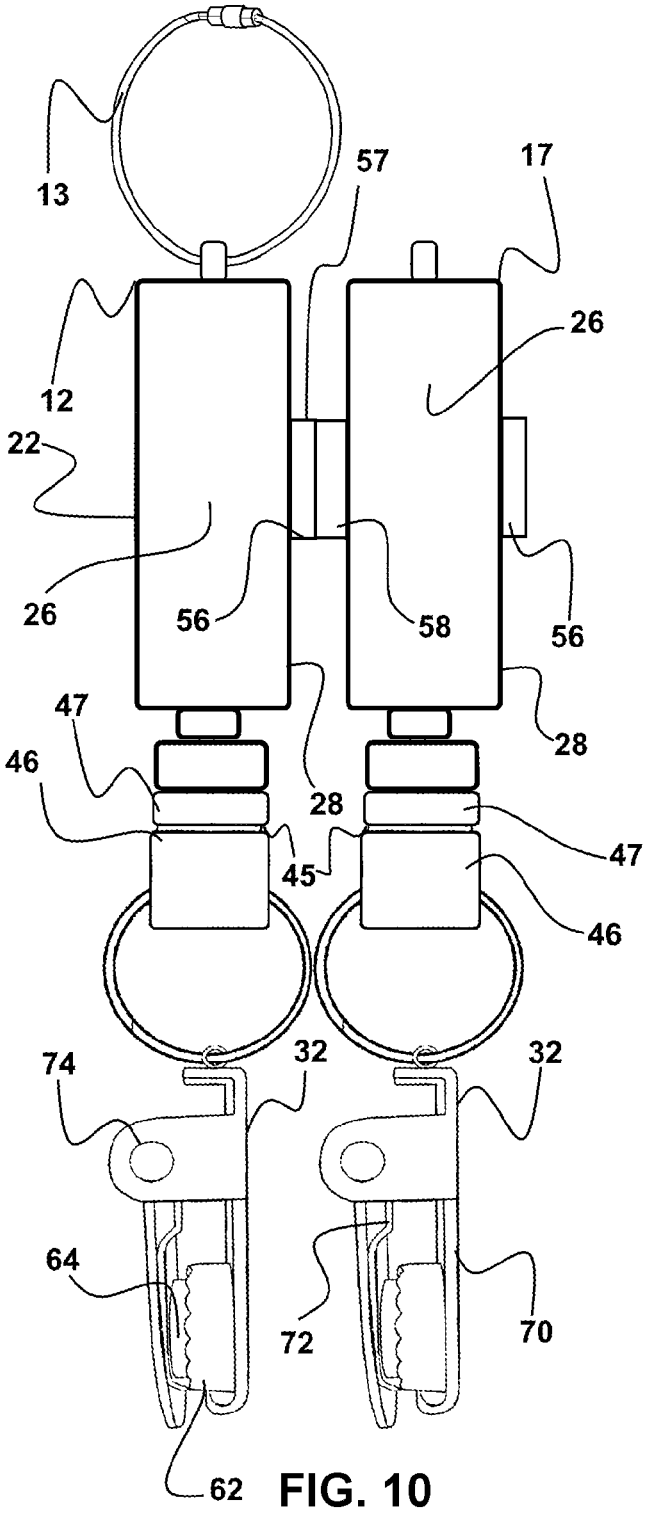
FIG. 10 shows a side view of the mode of the housing, as in FIG. 9, having a first or primary housing having a bag connector and with the first housing in a sequenced engagement to a secondary housing using housing connecters therebetween.

Also shown in FIGS. 8 and 10 are depictions of stacked or sequenced positioning, where a primary housing 12, which is any housing having a bag connector 13 for engaging it to a golf bag 15, is engaged in sequential connections to one or more secondary housings 17. As noted, a first portion 56 of a housing connector 57 is positioned on one sidewall of each adjacently positioned primary or secondary housing, which is configured to connect to a second portion 58 of a housing connector 57 on the adjacent primary housing 12 or secondary housing 17 (FIG. 10). This allows for this sequenced positioning which helps to prevent tangling of the respective flexible members 20, when they are operatively engaged to covers 34. This stacked or sequenced positioning also allows for a single attachment point of the primary housing 12 to the golf bag 15 using the bag connector 13.

As also noted, in all modes of the system 10, the housing connector 57 can be configured using first and second portions thereof which formed by housing connectors 57 which are magnets, adhesive, twist locks, hooks and hook receptors, and other configurations of such housing connectors 57, where one half engages the other, as would occur to those skilled in the art. In a simple mode of the housing connector 57, it can be adhesive, where a first sidewall 22 of one housing 12 is adhesively engaged to one side of an adjacent housing 12 or 17 to yield the sequenced positioning of a plurality of housings, such as in FIG. 8 or 10. As noted, in such a sequenced positioning and engagement of housings 12 and 17, the first or primary housing 12 has the bag connector 13 thereon and holds all of the plurality of housings to the golf bag 15, which avoids the tangling problems encountered, in experimentation, when the housings 12 and 17 were attached separately and not in a sequenced engagement.

As noted above, FIG. 9 depicts a mode of the system 10 herein showing a primary housing 12 having a bag connector 13 in an attachment thereto. The bag connector 13 is employed to engage the primary housing 12 to a golf bag 15, such as shown in FIG. 8. Also shown are the flexible member 20 having a rotating barrel connector 45 in an engagement to a clip 32, such as with a ring or other connector in a direct connection to the barrel connector 45.

In FIG. 10 is shown a side view of a plurality of housings in a sequenced or stacked engagement to each other.
The stacked housings show the primary housing 12 of FIG. 9 in a typical configuration of both primary housings 12 and secondary housings 17 where the housing is simpler. As shown, the surrounding sidewall 26 is in a sandwiched positioning between a first cavity sidewall 22 and a second sidewall 28 on all of the housings. The internal components, such as the reel 14 and axle 18, operate as described above.

The housing connector 57 engages each adjacently positioned primary or secondary housing to the others by connection of the first portion 56 of the housing connector on one housing to the second portion 58 of the housing connector 57 on the other. There can be any number of housings in the stacked or sequential engagement and each would engage the adjacent housings in this manner, and the connected sequence of housings will only have to engage the bag 15 with the bag connector 13 on what would be the primary housing 12, since it has the bag connector 13 thereon. As noted above, the housing connector 57 can be formed in many configurations, so long as the first portion 56 thereof will engage the second portion 58 thereof.

Figure 11:
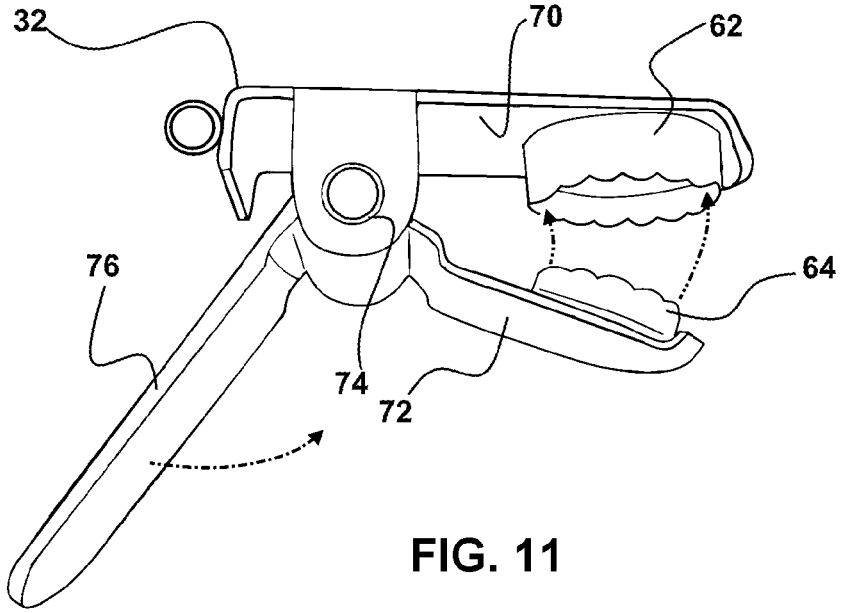
FIG. 11 depicts an especially preferred clip for engagement to the flexible member, in all modes of the device herein, which is shown in an open position.

Shown in FIG. 11, is an especially preferred configuration for the clip 32 for the system 10 herein which is employed for engagement to the flexible member 20 to a club cover 34. Such was found to be superior as noted after experimentation with a number of clip configurations. As shown in FIG. 11, the clip is shown where the lever 76 has been rotated away from any contact with the second clip member 72 and causes the clip members 72 and 74 to separate to an open position, ready for engagement to a club cover 34. As can be seen in FIG. 11, in the open position, a gap is formed between the first clip contact 62 and second clip contact 64 for insertion of the club cover 34 therebetween.

Particularly preferred are the depicted first clip contact 62 which is substantially configured in a first circle which is positioned on a first clip member 70 manner such that it surrounds the circular second clip contact 64 located on the second clip member 72. The first clip contact 62 has a circumference larger than the second clip contact 64. When the clip 32 is biased by a clip spring 74 to a closed position in FIG. 12 upon the release of the clip lever 76, the first clip contact 62 surrounds and encloses the second clip contact 64, and the fabric of the clip cover 34 is held between them. So held the clip cover 34 is engaged in a circular path and extends from under the second clip contact 64 and through a circular gap 65 formed between the first clip contact 62, when it surrounds the second clip contact 64 positioned therein, as in FIG. 12.

Figure 12:
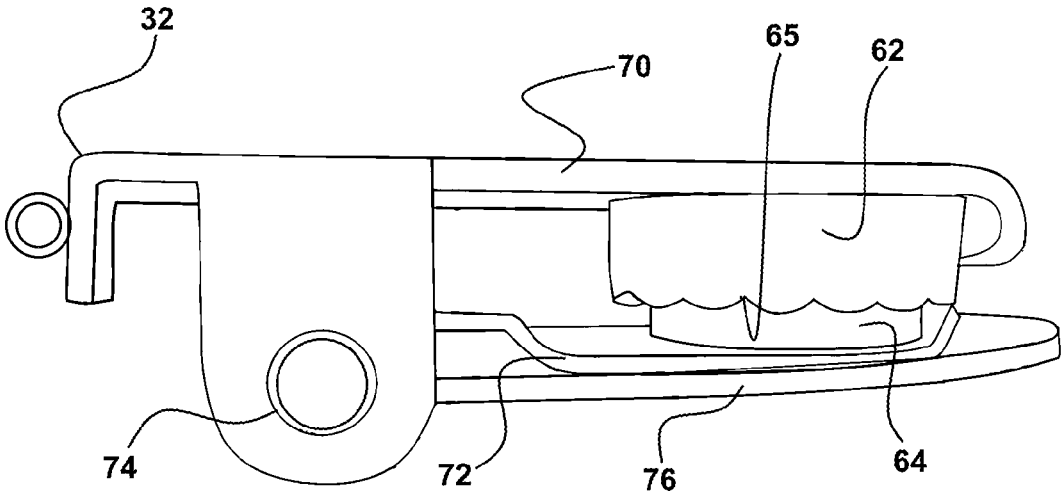
FIG. 12 shows the clip of FIG. 11 in a closed position.

Also, as shown in FIG. 12, the lever 76 can be rotated to a position substantially parallel to the second clip member 72 and contacts it. When so rotated, the lever 76 is in a locked position and locks the clip 32 into the closed configuration of FIG. 12. This clip 32 configuration was found to be superior in preventing the club cover 34 from sliding out of the grip between clip contacts of a closed clip 32 such as a conventional alligator type clip with linear jaws which meet when closed.

The description of the features of the modular golf club cover retainment invention does not limit the claims of this application, and, other applications developed by those skilled in the art upon reviewing this application are considered to be included in this invention.

It is additionally noted and anticipated that although the cover retainment device is shown in its most simple form and potential configurations, various components and aspects of the disclosed wing system may be differently shaped or slightly modified when forming the invention herein. As such, those skilled in the art will appreciate the descriptions and depictions set forth in this disclosure are merely meant to portray examples of preferred modes of the modular golf club cover retainment system herein within the overall scope and intent of the invention, and are not to be considered limiting in any manner.

Further, while all of the fundamental characteristics and features of the golf club cover retainment invention have been shown and described herein, with reference to particular embodiments thereof, a latitude of modification, various changes and substitutions are intended in the foregoing disclosure as well as the claims which follow, and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A golf club cover retainment apparatus, comprising:

a first housing, said first housing having an internal cavity positioned between a first sidewall, a second sidewall and a surrounding sidewall positioned between said first sidewall and said second sidewall;

said first housing having a bag connector for forming an engagement of said first housing to a golf bag;

a reel located within said internal cavity;

an opening in said first housing communicating with said internal cavity;

a flexible member engaged at a first end with said reel, said flexible member extending through said opening to a second end thereof;

a clip in a connection to said second end of said flexible member, said clip being positionable to a removable engagement to a golf club cover;

said reel in a biased engagement urging said reel to wind said flexible member thereon;

a secondary housing, having a second internal cavity positioned therein, between a first sidewall, a second sidewall and a surrounding sidewall thereof;

a secondary reel located within said internal cavity of said secondary housing;

an opening in said secondary housing communicating with said second internal cavity thereof;

a second flexible member engaged at a first end thereof with said secondary reel, said second flexible member extending through said opening in said secondary housing to a second end thereof;

a second clip in a connection to said second end of said second flexible member, said second clip being positionable to a removable engagement to a second golf club cover;

a housing connector for engaging one of said first sidewall or said second sidewall of said first housing to one of said first sidewall or said second sidewall of said second housing to form a sequential engagement of said first housing to said second housing; and said first housing and said second housing in said sequential engagement being held in a connection to said golf bag by said bag connector; and whereby with said first housing in said connection to said golf bag, said second golf cover, in said removable engagement to said second clip, is held proximate to said golf bag.

2. The golf club cover retainment apparatus of claim 1 additionally comprising:

said connection to said second end of said second flexible member to said second clip is a second rotating connection allowing said second clip to rotate without twisting said second flexible member.

3. The golf club cover retainment apparatus of claim 1 additionally comprising:

said secondary reel in a second biased engagement upon an axle within said second internal cavity, said second biased engagement rotating said secondary reel to a continuous winding of said second flexible member thereon; and said continuous winding of said second flexible member forming a second taught section thereof, between said opening in said secondary housing and said second clip.

4. The golf club cover retainment apparatus of claim 2 additionally comprising:

said secondary reel in a second biased engagement upon an axle within said second internal cavity, said second biased engagement rotating said secondary reel to a continuous winding of said second flexible member thereon; and said continuous winding of said second flexible member forming a second taught section thereof, between said opening in said secondary housing and said second clip.

* * * * *